US006202721B1

(12) United States Patent
Stegmaier

(10) Patent No.: US 6,202,721 B1
(45) Date of Patent: Mar. 20, 2001

(54) MOUNTING ARRANGEMENT FOR A CUTTING BLADE IN A CUTTING HEAD

(75) Inventor: Bernd Stegmaier, Ellenberg (DE)

(73) Assignee: Hapro-Hartmetall-Profiltechnik GmbH, Ellenberg (DE)

( * ) Notice: Subject to any disclaimer, the term of this patent is extended or adjusted under 35 U.S.C. 154(b) by 0 days.

(21) Appl. No.: 09/071,321

(22) Filed: May 1, 1998

(30) Foreign Application Priority Data

Oct. 31, 1997 (DE) ..... 297 19 419 U

(51) Int. Cl.[7] ..... B27G 13/04

(52) U.S. Cl. ..... 144/230; 144/218; 144/241; 407/37; 407/45; 407/113; 83/698.61

(58) Field of Search ..... 83/663, 698.41, 83/698.51, 698.61, 836, 844, 699.51, 699.61; 144/114.1, 117.1, 130, 218, 230, 241; 407/36–41, 44–47, 49, 113

(56) References Cited

U.S. PATENT DOCUMENTS 420,522 * 2/1890 Sweet ..... 407/45 X
1,037,146 * 8/1912 Hunter ..... 83/836
1,458,671 * 6/1923 Westgard ..... 83/836
1,642,185 * 9/1927 Westgard ..... 83/836
1,650,884 * 11/1927 Westgard ..... 83/836
1,810,823 * 6/1931 Freas et al. ..... 83/836
3,119,294 * 1/1964 Billingsley et al. ..... 83/698.61 X
3,791,429 * 2/1974 Morris ..... 144/218
3,913,645 * 10/1975 Maier ..... 144/218
3,946,474 * 3/1976 Hahn et al. ..... 407/37
4,343,215 * 8/1982 Fuchs ..... 83/698.41 X
4,400,117 * 8/1983 Smith ..... 83/698.41 X
4,429,726 * 2/1984 Betzler ..... 144/230 X
5,176,191 * 1/1993 Owens ..... 144/230
5,571,250 * 11/1996 Stegmaier ..... 144/218

* cited by examiner

*Primary Examiner*—Clark F. Dexter
(74) *Attorney, Agent, or Firm*—Klaus J. Bach

(57) ABSTRACT

In a mounting arrangement for supporting, in a stepwise adjustable fashion, a cutting blade in a cutting head for working wood or plastic, the cutting blade has at least one cutting edge and opposite side edges with wave-like profile structures and claw elements are mounted on the cutting head and have engagement portions extending into the troughs of the wave-like profile structures for form-fitting engagement therewith. Each wave-like profile structure has a greater length in the direction of the side edges of the cutting blade than the respective engagement portions of the claw elements so that the position of the cutting blade is adjustable.

4 Claims, 3 Drawing Sheets

MOUNTING ARRANGEMENT FOR A CUTTING BLADE IN A CUTTING HEAD

BACKGROUND OF THE INVENTION

The invention relates to an arrangement for mounting cutting blades in radially stepwise adjustable positions in cutting heads for the machining of wood or plastic.

Cutting heads for working or machining wood or plastic are operated at high speeds whereby the cutting heads are subjected to high centrifugal forces during operation. This requires secure mounting of the cutting blades in the cutting head so that they cannot move radially during operation under the influence of the centrifugal forces. Radial movability of a cutting blade could not only lead to an accident but would also render the machined product unusable.

In order to be able to utilize the hard metal cutting blades for an extended period of time, it is advantageous if, after some wear of the ground cutting edge, a cutting blade can be remounted with slight radial outward displacement so that, after corresponding regrinding of the cutting edge, the cutting blade can again be used. Also the cutting blades may be reversible blades which, after the cutting edge at one side is worn, can be turned over by 180° so that another cutting edge formed on the opposite, inner side of the cutting blade is then disposed on the outside and, after being firmly mounted in the cutting head, can again be used for cutting.

It is the object of the present invention to provide a mounting arrangement for the secure radial mounting of cutting blades in high speed cutting heads whereby a secure radial positioning of the cutting head is insured, but the cutting blades radial positions are adjustable by at least one step so that, after repositioning, they can be reground and the cutting heads can be reused for another period of operation. Also, the arrangement should be simple and inexpensive to make.

SUMMARY OF THE INVENTION

In a mounting arrangement for supporting, in a stepwise adjustable fashion, a cutting blade in a cutting head for working wood or plastic, the cutting blade has at least one cutting edge and opposite side edges with wave-like profile structures and claw elements are mounted on the cutting head and have engagement portions extending into the troughs of the wave-like profile structures for form-fitting engagement therewith. Each wave-like profile structure has a greater length in the direction of the side edges of the cutting blade than the respective engagement portions of the claw elements so that the position of the cutting blade is adjustable.

In a relatively simple arrangement, the mounting elements can be cylindrical pins which are in engagement with correspondingly formed recesses in the cutting blades. They may also be in the form of claws which have a wave profile along one of the side edges thereof, that is complementary to the wave profile provided on the cutting blades wherein the profile projections of the claws are engaged in the recesses in the cutting blade side edges. The wave profile on the side edges of the cutting blades extends over a wider area then the complementary profile on the mounting elements so that the cutting blades can be adjusted by at least one step, that is, by at least one wave spacing. Preferably, the edge areas of the cutting plate provided with the wave profile are recessed with respect to the rest of the edge of the cutting blade side edge, that is, the cutting blades have cut-outs in their sides and the wave profile is formed on the side walls of the cutouts in the cutting blades.

If the cutting blades are designed as reversable blades the cutouts are provided in the center of the respective side edges of the cutting blade.

The mounting arrangement according to the invention has the advantage that it is easy to manufacture and is absolutely safe in operation. This advantage is particularly noteworthy with regard to arrangements presently in use, wherein the cutting blades include openings into which retaining elements project. Such openings are difficult to form into the hard metal plates and it is particularly difficult to cut such openings with the required accuracy. When such openings are only roughly sized and provided with a plastic filling into which accurately sized openings are cut the engagement surfaces formed thereby are relatively soft so that they may not provide accurate support.

Some embodiments of the invention will be described on the basis of the accompanying drawings.

DESCRIPTION OF PREFERRED EMBODIMENTS

Figure 1:
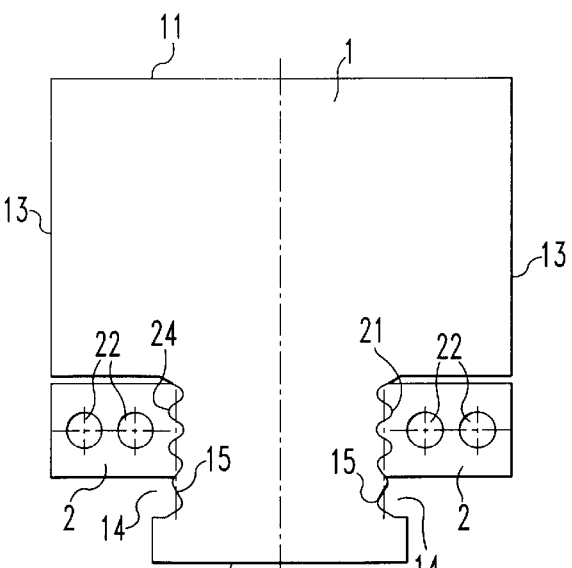
FIG. 1 shows a cutting blade with a cutting blade engagement structure according to the invention.

FIG. 1 shows a cutting blade 1 with a front edge 11 onto which a cutting edge is ground, a rear edge 12 and two side edges 13. Cut-outs 14 are provided in the rear areas of the two side edges 13 and a wave profile 15 is ground into the cutting blade side walls in the cut-out areas 14.

Claw elements 2 provided with oppositely shaped projections, that is with a wave profile 21 complementary to the wave profile 15 of the cutting blade sidewalls, engage the wave profile 15. The claw elements 2 have bores 22 for mounting the claw elements 2, by pins extending through the bores 22, to a cutting head.

The wave profile 15 in the cut-outs 14 of the side edges 13 of the cutting blades have a greater length, that is they have more waves, than the wave profile 21 of the claw elements 2 so that the position of the cutting blade is adjustable. In the embodiment shown, the cutting blade can be moved forward by one notch and can be held in such a forward position.

It can be seen that the cut-outs 14 in the side walls of the cutting blade are so selected and the claw elements 2 are so sized that the radially outer edges of the claw elements 2 are aligned with the side edges 13 of the cutting blade.

Figure 2:
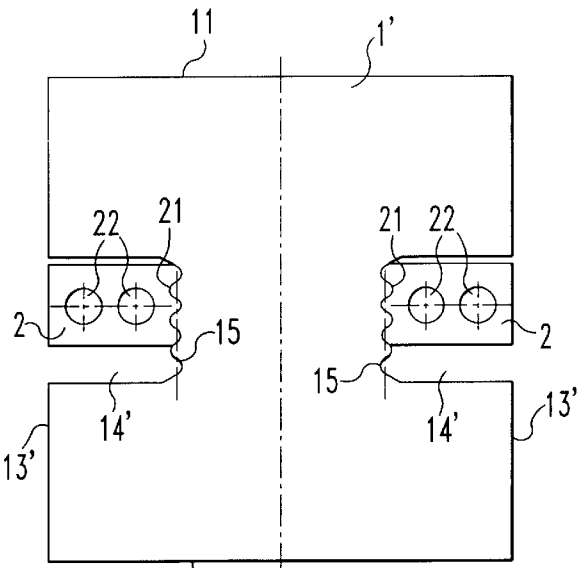
FIG. 2 shows a reversable cutting blade with cutting edges formed at opposite sides and a cutting blade engagement structure formed in the center area of the cutting blade.

The embodiment of FIG. 2 differs from that of FIG. 1 in that the cutting blade 1' is a reversible blade which is ground at the front edge 11 as well as at the rear edge 12'. The cut-outs 14' at the sides with the ground-in wave profile 15 are in the center area of the side edges 13' of the cutting blade such that the cutting blade is symmetrical. Otherwise, the mounting arrangement with the cutouts 14' and the ground-in profiles 15 of the cutting blade 1' and the corresponding claw elements 2 are the same as those according to FIG. 1.

Figure 3:
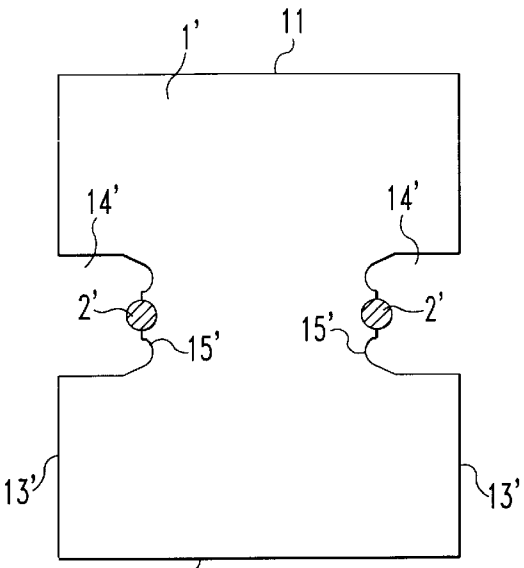
FIG. 3 shows a cutting blade with a simplified engagement structure.

FIG. 3 shows a simplified embodiment of the arrangement according to the invention which may be utilized in connection with a simple cutting blade 1 having a single cutting edge as well as with a reversible cutting blade having cutting edges at opposite ends.

With this simplified embodiment, the claw elements are formed by cylindrical pins 2' whose outer surfaces are in direct contact with the wave profile 15' in the cutouts 14' of the side edges 13' of the cutting blade 1". As can be seen from the figure, in this case, also the wave profile 15' may be simplified as it comprises merely a small number of adjacent semicircular recesses without curved wave projections.

Figure 4:
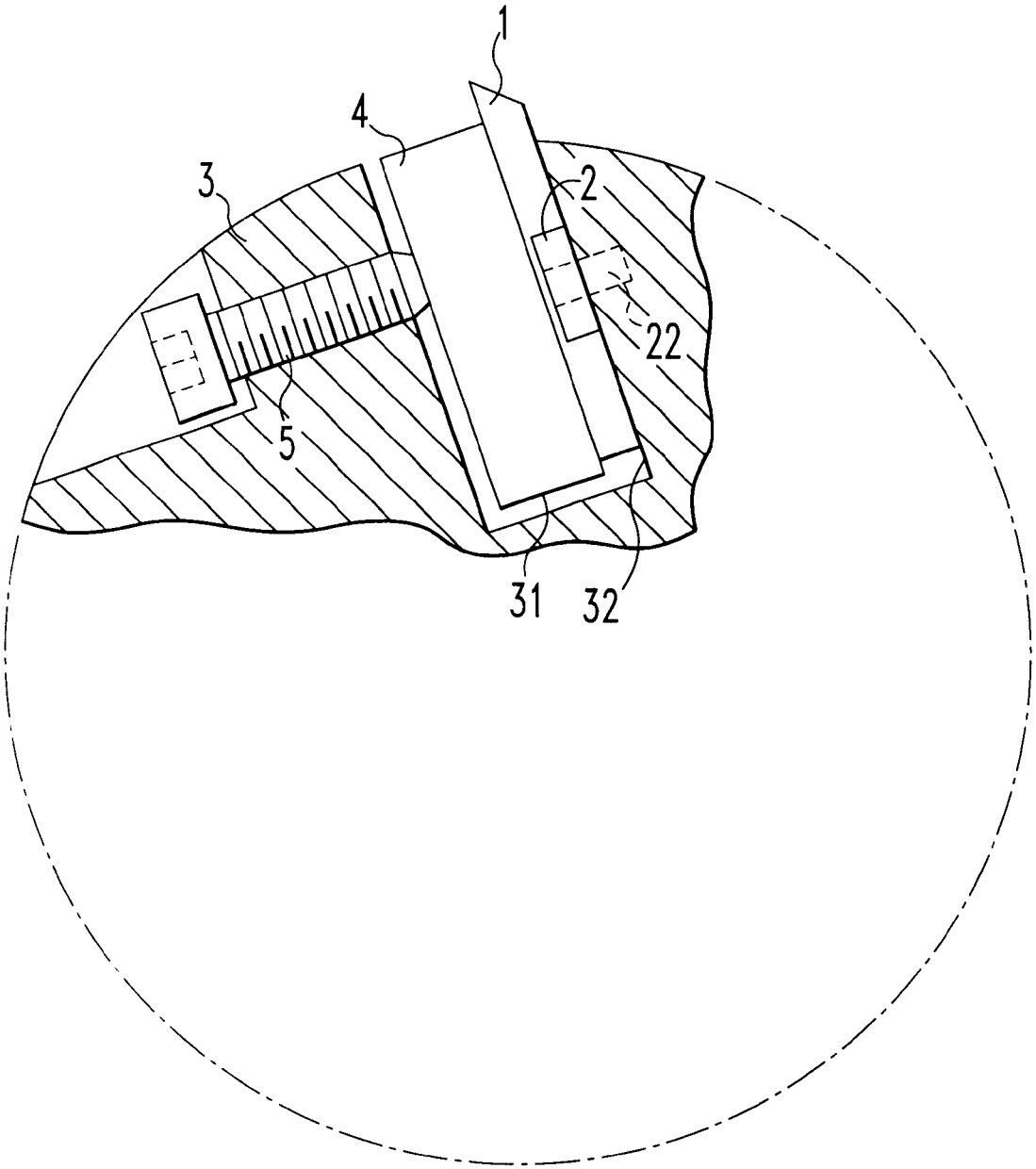
FIGS. 4 and 5 show cutting heads with cutting blades mounted therein.

FIG. 4 shows schematically a cutting head 3, which includes several cutting blades 1 mounted thereon around its circumference, only one being shown in FIG. 4. To receive a cutting blade 1, the cutting head includes a cavity 31 with a support wall 32 on which the cutting blade 1 is disposed. The claw elements 2 are held in place by the pins 22' as shown in greater detail in FIGS. 1 and 2 for radially positioning and securing the cutting blade 1. Alternately, only pins 2' may be provided on the support surface 32 as shown for the embodiment of FIG. 3. As it is common, a clamping wedge 4 may be inserted into the cavity adjacent the cutting blade 1, wherein the clamping wedge 4 is pressed against the cutting blade 1 by a screw 5 in order to firmly engage the cutting blade 1.

Figure 5:
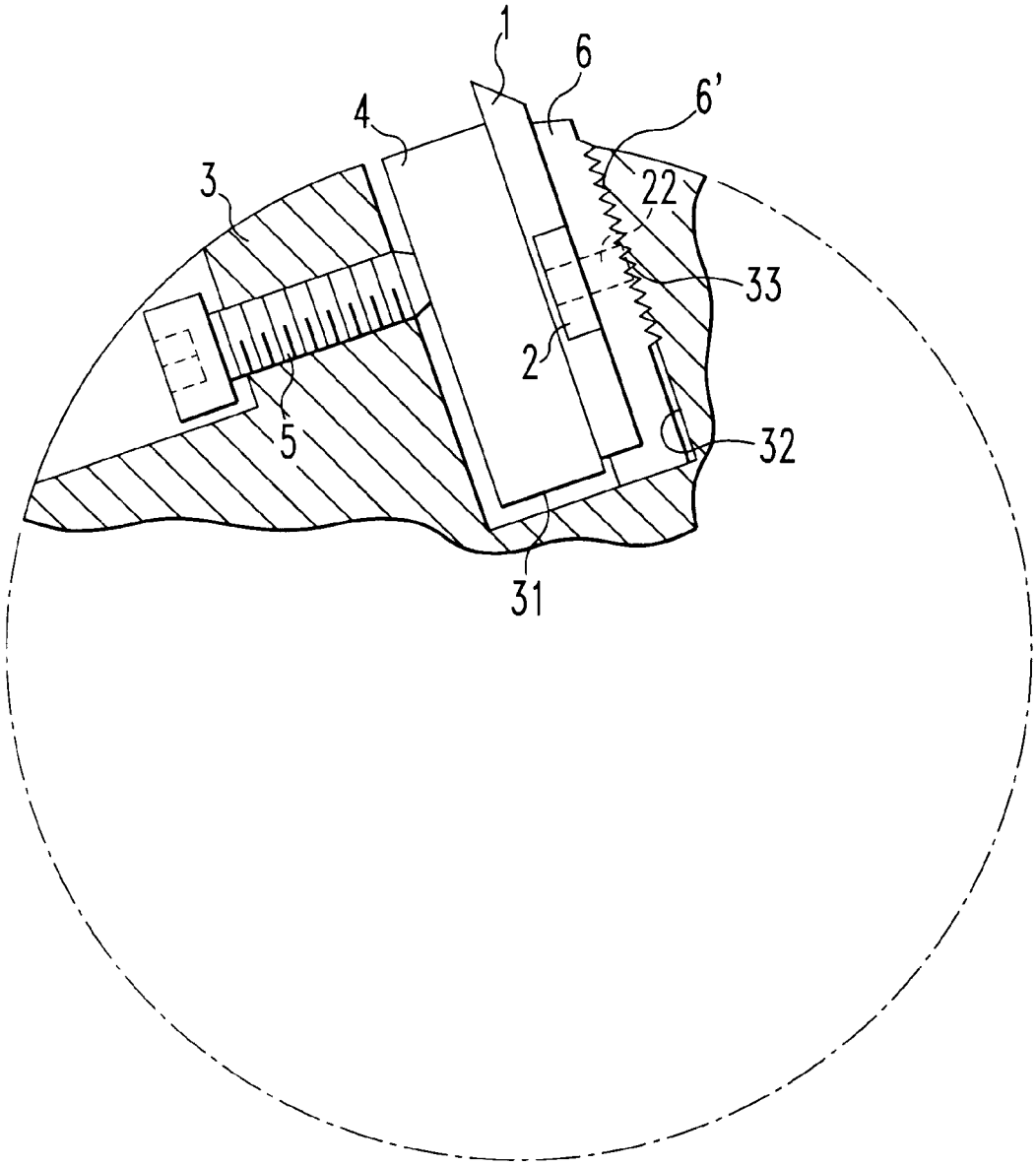

As shown in FIG. 5 a support plate 6 may be disposed between the cutting blade 1 and the support wall 32 which is radially adjustable to provide appropriate support for the cutting blade 1. At its back side the support plate 6 preferably has a toothed profile 6' and also the support wall is provided with a corresponding toothed profile 33 so that the support plate is engaged with the support wall in a form-locking relationship to prevent radial movement when subjected to the high centrifugal forces during wood cutting. In this case, the claw elements 2 for the cutting blades and the pins 22 or 2' are mounted on the support plate 6.

What is claimed is:

1. A mounting arrangement for supporting, in a stepwise adjustable fashion, a cutting blade in a cutting head for working wood or plastic, said cutting blade having at least one cutting edge and opposite side edges with cut-outs therein, the cut-outs forming opposite side edge areas with a recessed wave profile structure ground into each said side edge area, claw elements mounted on said cutting head and disposed fully within said cut-outs, each claw element having an engagement structure in form-fitting engagement with a corresponding one of the wave profile structures ground into said opposite side edge areas for firm engagement between said cutting blade and said claw elements, said wave profile structures ground into the side edge areas of said cutting blade having a length in the longitudinal direction of said side edges of said cutting blade which is greater than that of the engagement structures of said claw elements by at least one wave length of said wave profile structures so as to permit adjustment of the position of the cutting blade by at least one step.

2. A mounting arrangement according to claim 1, wherein said cut-outs are disposed in the center of the side edges of said cutting blade.

3. A mounting arrangement according to claim 1, wherein said engagement structure comprises a projection structure formed on the side edge of said claw elements, wherein each projection structure includes wave projections complementary to the wave profile structures on said cutting blades, but with fewer projections than there are wave troughs in the wave profile structures of said cutting blade.

4. A mounting arrangement according to claim 1, wherein said claw elements each consist of a cylindrical pin extending into one wave trough of the corresponding wave profile structure ground into the side edge areas of said cutting blade cut-outs, and wherein said wave profile structures each comprise at least two wave troughs.

* * * * *